US010473100B2

(12) United States Patent
Peters et al.

(10) Patent No.: US 10,473,100 B2
(45) Date of Patent: Nov. 12, 2019

(54) PUMP EXHIBITING AN ADJUSTABLE DELIVERY VOLUME

(71) Applicant: Schwäbische Hüttenwerke Automotive GmbH, Aalen-Wasseralfingen (DE)

(72) Inventors: Sven Peters, Bad Schussenried (DE); Stefan Küchle, Erolzheim (DE); Thomas Wahl, Ertingen (DE); Fabian Eisele, Herbertingen (DE); Thomas Finsterle, Ravensburg (DE); Volker Stöhr, Moosburg (DE)

(73) Assignee: Schwäbische Hüttenwerke Automotive GmbH, Aalen-Wasseralfingen (DE)

( * ) Notice: Subject to any disclaimer, the term of this patent is extended or adjusted under 35 U.S.C. 154(b) by 218 days.

(21) Appl. No.: 15/370,358

(22) Filed: Dec. 6, 2016

(65) Prior Publication Data

US 2017/0167484 A1 Jun. 15, 2017

(30) Foreign Application Priority Data

Dec. 11, 2015 (DE) ..... 10 2015 121 672

(51) Int. Cl.
*F04C 14/22* (2006.01)
*F04C 2/344* (2006.01)

(52) U.S. Cl.
CPC ..... *F04C 14/226* (2013.01); *F04C 2/344* (2013.01); *F04C 2/3442* (2013.01); *F04C 14/223* (2013.01)

(58) Field of Classification Search
CPC ..... F04C 2/344; F04C 2/3442; F04C 14/223; F04C 14/226
See application file for complete search history.

(56) References Cited

U.S. PATENT DOCUMENTS 9,109,596 B2 * 8/2015 Ohnishi ..... F04C 2/344
9,347,344 B2 * 5/2016 Watanabe ..... F04C 2/3442
(Continued)

FOREIGN PATENT DOCUMENTS

CN 101084378 A 12/2007
WO 2006066405 A1 6/2006
WO 2008037070 A1 4/2008

OTHER PUBLICATIONS

Extended European Search Report for EP Application No. 16203242.9, dated Jun. 14, 2017 with partial translation, 9 pages.
(Continued)

*Primary Examiner* — Peter J Bertheaud
(74) *Attorney, Agent, or Firm* — RatnerPrestia

(57) ABSTRACT

A pump which exhibits an adjustable delivery volume, the pump including (a) a pump housing comprising a delivery chamber; (b) a delivery rotor which can be rotated about a rotary axis within the delivery chamber, for delivering the fluid; (c) an adjusting device, including: (c1) an adjusting member which can be adjusted in the pump housing in order to adjust the delivery volume of the pump; (c2) a first setting chamber for generating a first setting pressure for adjusting the adjusting member; (c3) and a second setting chamber for generating a second setting pressure for adjusting the adjusting member; (d) a fluidically operable valve for adjusting the setting pressure of the first setting chamber; (e) and an electromagnetic valve, comprising: a pressure port for a setting fluid which is diverted from the high-pressure side; and a relief port for the setting fluid.

16 Claims, 2 Drawing Sheets

(56) References Cited

U.S. PATENT DOCUMENTS

| | | | | |
|---|---|---|---|---|
| 9,410,514 | B2 * | 8/2016 | Watanabe | F02M 39/02 |
| 9,494,152 | B2 * | 11/2016 | Saga | F04C 2/344 |
| 9,494,153 | B2 * | 11/2016 | Watanabe | F04C 2/3442 |
| 9,670,925 | B2 * | 6/2017 | Watanabe | F04C 2/3442 |
| 9,670,926 | B2 * | 6/2017 | Ohnishi | F01M 1/02 |
| 2009/0022612 | A1 | 1/2009 | Williamson et al. | |
| 2013/0164163 | A1 * | 6/2013 | Ohnishi | F04C 2/344 418/27 |
| 2014/0072456 | A1 | 3/2014 | Watanabe et al. | |
| 2015/0252803 | A1 | 9/2015 | Ohnishi et al. | |

OTHER PUBLICATIONS

German Office Action issued in German Patent Application No. 10 2015 121 672.8 dated Sep. 28, 2016 (4 pages).
Chinese Office Action issued in Chinese Patent Application No. 201611140878.0, dated Jul. 1, 2019 with translation, 14 pages.

* cited by examiner

PUMP EXHIBITING AN ADJUSTABLE DELIVERY VOLUME

CROSS REFERENCE TO RELATED APPLICATIONS

This application claims priority to German Patent Application No. 10 2015 121 672.8, filed Dec. 11, 2015. The contents of such application being incorporated by reference herein.

FIELD OF THE INVENTION

The invention relates to a pump exhibiting an adjustable delivery volume, which comprises an adjusting device and assigned valves for adjusting the delivery volume. In particular, the invention relates to a pump which comprises an adjusting device for adjusting the specific delivery volume of the pump. The valves are fluidically connected to the adjusting device, in order to be able to adjust the delivery volume of the pump by applying pressurised setting fluid to the adjusting device. The pump can be used to supply an assembly, in particular an assembly of a vehicle such as for example a motor vehicle, with lubricating oil, working fluid or cooling fluid. The pump is expediently a displacement pump. In preferred applications, the pump is used as a lubricating oil pump for supplying an internal combustion engine of a vehicle with lubricating oil, i.e. it is an engine lubricating oil pump.

BACKGROUND OF THE INVENTION

In accordance with a common design in engine lubricating oil pumps, the oil delivered by the pump, i.e. the oil from the high-pressure side of the oil circulation supplied by the pump, is applied to an adjusting member which is used to influence the delivery volume, such as for example a setting ring which can be pivoted. In this way, the delivery volume flow is limited when a particular pressure threshold is reached. Depending on the ancillary constraints of the engine, such as for example the rotational speed of the engine, the temperature of the engine, the need to cool pistons and so forth, an adjustment of the delivery volume—preferably, the specific delivery volume—is often implemented in the form of two or as applicable even more pressure stages, wherein it is alternatively or additionally possible to regulate the pump in accordance with an engine characteristic map, i.e. to perform characteristic-map regulation. In simple cases, pressure can be directly applied to the adjusting member using a manifold valve which is actuated by the engine controller. If the electromagnetically operable manifold valve cannot be arranged in or on a housing of the pump and/or if, for design reasons, the flow cross-sections in the valve or on the route to or from the valve cannot be dimensioned so as to be sufficient for rapid adjustment, a hydraulic valve can be provided which controls the application of pressure to or relief of pressure on the adjusting member which can commonly be moved against the force of a spring. At least in such embodiments, a pressure which acts on a partial surface of a pilot piston of the hydraulic valve, which is typically embodied as a stepped piston, is modulated using the manifold valve which can be electromagnetically actuated.

WO 2006/066405 A1, which is incorporated by reference, discloses a pump comprising an adjusting member which can be adjusted back and forth in order to adjust the delivery volume and to which a setting pressure is applied in a setting direction in each of two setting chambers. A spring device acts on the adjusting member, counter to the setting pressures, in a restoring direction. In the first setting chamber, a setting fluid which is diverted from the high-pressure side of the pump is directly applied to the adjusting member. The setting pressure which prevails in the second setting chamber can be adjusted by means of an electromagnetic valve. It is also mentioned in relation to the first setting chamber that in modified embodiments, the setting pressure of the first setting chamber could alternatively also be adjusted by means of an electromagnetic valve.

WO 2008/037070 A1, which is incorporated by reference, discloses a pump comprising an adjusting member which can be adjusted in order to adjust the delivery volume and to which a first setting pressure is applied in a setting direction in a first setting chamber and to which a second setting pressure is applied in a setting direction in a second setting chamber. A spring device acts in the restoring direction, counter to the setting pressures. A fluidically operable valve is connected upstream of each of the two setting chambers, in order to be able to alter the setting pressure of the respective setting chamber. Setting fluid diverted from the high-pressure side of the pump is fed to each of the fluidically operable valves. The setting fluid can be fed via the valves of the respectively assigned setting chamber or can be drained into a reservoir. One of the two valves is directly operated using a control fluid diverted from the high-pressure side of the pump. The other of the two valves is fluidically operated by means of an electromagnetic valve.

SUMMARY OF THE INVENTION

An aspect of the invention provides a pump which can be adjusted in terms of its delivery volume and which is simplified in relation to the valves used for adjusting, but which can nonetheless be flexibly adapted to the requirements of an assembly to be supplied.

An aspect of the invention proceeds from a pump which exhibits an adjustable delivery volume and comprises: a pump housing comprising a delivery chamber; a delivery rotor which can be rotated about a rotary axis within the delivery chamber; an adjusting device for adjusting the delivery volume of the pump; a fluidically operable valve for applying a setting fluid to the adjusting device in a controlled way; and an electromagnetic valve, also for applying a setting fluid to the adjusting device. The delivery chamber comprises a delivery chamber inlet on a low-pressure side, and a delivery chamber outlet on a high-pressure side, for a fluid to be delivered by means of the delivery rotor.

If the pump is arranged in a pump circulation, the low-pressure side of the pump extends from a reservoir, from which the pump suctions the fluid, up to at least the delivery chamber inlet via an inlet of the pump housing. If the transition from low pressure to high pressure occurs within the delivery chamber, the low-pressure side of the pump also comprises the low-pressure side of the delivery chamber, i.e. extends on the low-pressure side up to and into the delivery chamber. The high-pressure side of the pump comprises the high-pressure region extending within the pump housing, and also extends via an outlet of the pump housing up to at least the assembly to be supplied with the fluid or, if the pump supplies multiple assemblies with the fluid, up to each of these assemblies. Unlike the terms "low-pressure side of the pump" and "high-pressure side of the pump", the term "suction region" is intended to denote a flow region extending only within the pump housing on the low-pressure side of the pump. On the other hand, the term "suction region" is not to be interpreted such that the pump in accordance with the invention has to suction the fluid from the reservoir against gravity. The pump can also be arranged at a point in its delivery cycle which is lower than the reservoir, such that the pump suctions the fluid with the assistance of gravity. The pump can also be pre-loaded, i.e. a pre-loading pump can be connected upstream of the pump.

The adjusting device comprises: an adjusting member which can be moved back and forth in the pump housing in a setting direction and a restoring direction in order to adjust the delivery volume of the pump; a first setting chamber for generating a first setting pressure for adjusting the adjusting member; and another, second setting chamber for generating a second setting pressure for adjusting the adjusting member. The first setting pressure is generated by a first setting fluid situated in the first setting chamber, and the second setting pressure is generated by a second setting fluid situated in the second setting chamber. The first setting fluid and the second setting fluid are preferably diverted from the high-pressure side of the pump.

In first embodiments, the first setting pressure in the first setting chamber and the second setting pressure in the second setting chamber each act directly on the adjusting member which correspondingly delimits both the first setting chamber and the second setting chamber. In second embodiments, both the first setting pressure in the first setting chamber and the second setting pressure in the second setting chamber act, each via a setting piston and correspondingly each indirectly, on the adjusting member.

The fluidically operable valve is used to adjust the setting pressure of the first setting chamber, and the electromagnetic valve is used to adjust the setting pressure of the second setting chamber. The fluidically operable valve comprises a control piston which can be adjusted by means of a pressurised control fluid. In preferred embodiments, this valve is fluidically operable only. The tensing force of a tensing device of the valve acts counter to the pressure of the control fluid. The fluidically operable valve is referred to in the following as the "fluidic valve". It can in particular be a hydraulic valve. The electromagnetic valve comprises a pressure port for a setting fluid which is diverted from the fluid of the high-pressure side of the pump; a working port for the setting fluid; and a relief port for the setting fluid. The electromagnetic valve is electromagnetically operable; preferably, it is electromagnetically operable only. The tensing force of a tensing device of the electromagnetic valve acts counter to the electromagnetic force.

In accordance with an aspect of the invention, the working port of the electromagnetic valve is connected to the second setting chamber in order to adjust the setting pressure of the second setting chamber. Because the invention combines a fluidic valve for adjusting the first setting pressure and an electromagnetic valve which is fluidically connected to the second setting chamber via its working port, a pump is obtained which is simpler than the prior art in relation to adjusting by means of the valves, but which can nonetheless be flexibly adapted in terms of its delivery volume to the requirements of an assembly or system of multiple assemblies to be supplied. A maximum pressure level is predetermined by the hydraulic valve, and the delivery volume of the pump is regulated down when this is reached. Since fluidic valves are particularly robust and reliable, and are independent of electrical energy and/or control signals, this ensures a simple, cheap and reliable way of regulating down when the maximum pressure level is reached. The maximum pressure level at which the delivery volume of the pump is regulated down can be adjusted by means of the electromagnetic valve in one or more stages, or also continuously and in principle in any way, depending on the design of the electromagnetic valve, up to the maximum predetermined by the fluidic valve.

The fluidic valve comprises: the control piston which has already been mentioned and which can be moved back and forth within a valve space of the fluidic valve between a first piston position and a second piston position; and a tensing device for generating a tensing force which acts on the control piston in the direction of one of the piston positions. The tensing device can comprise one or more springs for generating the tensing force. The tensing device can in particular be formed by a pressurised helical spring arranged in the valve space. The fluidic valve also comprises: a pressure port for a setting fluid which is diverted from the fluid of the high-pressure side; a working port for the setting fluid, which is connected to the first setting chamber; and a relief port for the setting fluid.

The tensing device of the fluidically operable valve is preferably provided for setting a piston position in which the first setting chamber is connected to the relief port of the fluidically operable valve. The control force which acts counter to the tensing device is preferably provided for setting a piston position in which the pressure port of the fluidically operable valve is connected to the first setting chamber. In order to generate the control force, the fluidically operable valve comprises an inlet for control fluid which is diverted on the high-pressure side of the pump. The inlet of the fluidically operable valve is permanently attached to the high-pressure side of the pump, hence a control force resulting from the control fluid is permanently acting against the tensing device of the fluidically operable valve.

The pressure port of the fluidically operable valve is advantageously connected to the working port of the fluidically operable valve and therefore to the first setting chamber when the control force reaches a value at which the control piston of the fluidically operable valve is moved against the tensing device into the piston position in which the pressure port of the fluidically operable valve is connected to the working port of the fluidically operable valve.

The tensing device of the fluidically operable valve exerts a tensing force on the control piston of the fluidically operable valve which is greater than a control force which occurs or results when the electromagnetic valve is properly and/or actively functioning and which acts against the tensing device of the fluidically operable valve. The tensing force acts counter to fluidically setting the piston position in which the pressure port of the fluidically operable valve is connected to the working port of the fluidically operable valve. The tensing force of the tensing device of the fluidically operable valve is configured such that the piston position in which the pressure port of the fluidically operable valve is connected to the working port of the fluidically operable valve is only set once a predetermined pressure level has been reached which is higher than a maximum pressure level to which the active and/or properly functioning electromagnetic valve regulates down.

When the electromagnetic valve is functioning properly and/or is active, the pump is regulated down to a maximum pump output pressure by the electromagnetic valve. This maximum pump output pressure results in a control force, acting against the tensing device of the fluidic valve, which is smaller than the tensing force of the tensing device of the fluidic valve and therefore preferably smaller than a necessary control force which is at least necessary in order to set the piston position in which the pressure port of the fluidic valve is connected to the working port of the fluidic valve and therefore to the first setting chamber. If the electromagnetic valve fails due to a defect, or if actuating the electromagnetic valve is deactivated in selected operational states, the pump is not regulated down by the electromagnetic valve, hence the pump output pressure can rise above the maximum pump output pressure. The fluidic valve limits this rise to a fail-safe pump output pressure. The fail-safe pump output pressure is greater than the maximum pump output pressure but smaller than a critical pump output pressure at which components could be damaged.

The fail-safe pump output pressure results in a control force, acting against the tensing device of the fluidic valve, which is greater than the tensing force of the tensing device of the fluidic valve and therefore preferably greater than the control force necessary to set the piston position in which the pressure port of the fluidic valve is connected to the working port of the fluidic valve. This ensures reliable operations even if the electromagnetic valve fails or is not actuated in particular operational states. This makes it possible to enable the pump to precisely and flexibly adapt to requirements, with a reliability of supply which is ensured even if the electromagnetic valve fails. It is possible to realise so-called second-level control or regulation of the delivery volume of the pump.

The control piston preferably comprises at least a first annular portion and a second annular portion which are axially spaced from each other. In one of the piston positions, the first annular portion separates the pressure port and the working port from each other and connects the working port to the relief port. In the other piston position, the first annular portion separates the working port and the relief port from each other and connects the pressure port to the working port. The second annular portion is arranged axially between the pressure port and the first annular portion. It is arranged axially between the pressure port and the working port. The second annular portion comprises at least one axial passage opening which fluidically connects the pressure port and the first annular portion to each other. In order to fluidically move the control piston against the tensing device, the control piston comprises at least one control surface on which the control fluid acts, resulting in the control force. The control surface is preferably formed by the first annular portion. The at least one passage opening of the second annular portion fluidically connects the control surface and the inlet for the control fluid of the fluidic valve. In the piston position in which the pressure port and the working port are connected to each other, the at least one passage opening fluidically connects the pressure port and the working port to each other. The term "axially" refers in particular to a longitudinal axis and/or shifting axis of the control piston of the fluidic valve, such that the expression "axially" denotes a direction which extends on or parallel to the longitudinal axis and/or shifting axis.

Preferably, a first axial end of the control piston comprises a first axial protrusion for arranging the tensing device, and a second axial end of the control piston comprises a second axial protrusion for forming an abutment. The tensing device, in particular the helical spring, is preferably arranged or fitted on the first axial protrusion. The first axial protrusion preferably forms a spring seating. The tensing device surrounds the first axial protrusion. In the piston position in which the pressure port and the working port are separated from each other, the second axial protrusion forms an abutment. In the piston position in which the pressure port and the working port are separated from each other, the second axial protrusion abuts a counter abutment. The axial protrusions exhibit a diameter which is respectively smaller than the diameters of the annular portions.

The first annular portion is formed as a solid body and is therefore not embodied to be hollow. Preferably, the entire control piston is formed as a solid body. In order to ensure that the control piston is correctly installed, the annular portions differ from each other in their diameter. The first annular portion preferably exhibits a diameter which is smaller than the diameter of the second annular portion. The fluidic valve also comprises a housing which comprises at least two regions which differ from each other in their inner diameter. The housing of the fluidic valve exhibits a stepped inner diameter. The diameter of the annular portions respectively abuts the inner diameter of the housing, and the annular portions are preferably guided on the inner diameter. The housing of the fluidic valve is advantageously formed by the pump housing, wherein the housing of the fluidic valve and/or a receptacle of the control piston of the fluidic valve is formed by a stepped bore.

The fluidic valve and/or electromagnetic valve can (respectively) comprise one or more other valve ports, for example another pressure port and/or another working port and/or another relief port. In simple embodiments, which not least for this reason are preferred embodiments, however, the fluidic valve and/or electromagnetic valve comprises only the three valve ports mentioned.

The control piston and the valve ports of the fluidic valve and/or electromagnetic valve can be arranged such that the working port is connected to the pressure port when the respective control piston assumes the first piston position, and the working port is separated from the pressure port and connected to the relief port when the respective control piston assumes the second piston position. The fluidic valve and/or electromagnetic valve can also be configured such that the control piston can assume a third piston position, and the working port is separated from both the pressure port and the relief port when the control piston assumes the third piston position. The third piston position can in particular be an intermediate position which the control piston can assume in a movement direction between the first piston position and the second piston position. The first piston position or instead the second piston position of the optionally three different piston positions can however in principle also be the intermediate position. Embodiments in which the fluidic valve and/or electromagnetic valve does not completely separate the working port from both the pressure port and the relief port in any piston position, but rather either separates the working port from the pressure port only and permits a comparatively small flow between the working port and the relief port, or separates the working port from the relief port and simultaneously permits a comparatively small flow between the working port and the pressure port, are also possible. The fluidic valve and/or electromagnetic valve is preferably a switching valve and can be switched between the states mentioned. The respective valve can in particular be embodied to exhibit only two switched states or precisely three switched states. The switched states are preferably defined by the piston positions.

The fluidic valve is preferably arranged in or on the pump housing. If it is arranged outside the suction region of the pump housing, the fluid can flow through the suction region with little resistance, since the flow in the suction region is not impeded by the fluidic valve. In preferred embodiments, the fluidic valve is arranged not only outside the suction region but rather outside the main flow through the pump housing. In the preferred embodiments, the fluidic valve therefore also does not impede the fluid from flowing off on the high-pressure side of the pump housing.

If the pump is arranged in a fluid delivery cycle, the fluidic valve is arranged outside the main flow of the delivery cycle in a secondary flow arm in preferred embodiments. The fluidic valve can thus be embodied independently of the requirement for a low-resistance main flow. The fluidic valve can be dimensioned to be correspondingly small and specifically optimised for performing its function of controlling the setting fluid for the first setting chamber. The main flow of the delivery cycle extends on the low-pressure side of the pump from the reservoir up to and into the pump housing and comprises the suction region of the pump housing. On the high-pressure side, the main flow comprises: the high-pressure region of the pump housing, through which the fluid flows from the delivery chamber up to and including an outlet of the pump housing; and the adjoining high-pressure region outside the pump housing up to at least an assembly to be supplied with the fluid by the pump. If the pump supplies multiple assemblies, the main flow is understood to be the flow to the assembly which has the highest volume requirement, measured as a volumetric flow rate, or which has to be supplied with the highest pressure.

The relief port of the fluidic valve and/or electromagnetic valve can be connected to the suction region of the pump by bypassing the reservoir. Setting fluid flowing off from the valve through the relief port can be fed back into the fluid delivery cycle of the pump in a relief channel downstream of the reservoir. The setting fluid flowing off from the valve through the relief port can be fed back into the main flow at a connecting point between the reservoir and the pump housing, wherein such a connecting point is preferably nearer the pump housing than the reservoir. The relief channel extends from the relief port up to the connecting point with the main flow. The fluidic valve and/or electromagnetic valve is advantageously not in fluid communication with the reservoir via the relief port. No fluid flows from the reservoir into the valve space of the fluidic valve and/or electromagnetic valve via the relief port, and in particular no fluid flows from the fluidic valve and/or electromagnetic valve to the reservoir via the relief port.

In preferred embodiments, the setting fluid is fed directly back into the suction region of the pump housing. In such embodiments, the relief channel feeds into the suction region, i.e. it directly adjoins the suction region. The feed into the suction region forms the connecting point mentioned.

Feeding the discharged setting fluid directly back into the suction region of the pump housing, or at least to a connecting point which is formed upstream of the pump port of the low-pressure side but downstream of the reservoir, counteracts the undesirable aeration which commonly occurs when it is fed back into the reservoir. The energy required to drive the pump is reduced, since the setting fluid which is fed back still has a higher pressure than the fluid situated in the reservoir. In particular in embodiments in which the setting fluid is fed directly back into the suction region of the pump housing, some pre-loading occurs on the low-pressure side of the pump. If, as is preferred, the fluid is a liquid such as for example a lubricating oil or a hydraulic oil, it is possible to counteract cavitation. If the setting fluid were discharged directly into the environment through the relief port, the setting fluid flowing back to the reservoir would be additionally contaminated. There would also be a risk of air, which reaches the working port via leaks and passes from there into the main flow which flows through the pump housing, being sucked into the fluidic valve and/or electromagnetic valve from the environment via the relief port. These two disadvantages are also eliminated by the invention. Another positive effect is that the valve is sealed off from the reservoir. If the pump is used as a lubricating oil pump or a working oil pump, this typically causes a circulation of air and oil in the region of the reservoir, which can retroactively affect the fluidic valve. This, too, is prevented by the invention. If the fluidic valve is arranged in or on the pump housing, and the relief channel leads from the fluidic valve up to and into the suction region through and/or on the pump housing, the pump together with the fluidic valve can be more easily fitted as an fitted unit, and the risk of fitting errors reduced, since the relief port does not have to be specially connected to the delivery cycle. It is in principle conceivable for the discharged setting fluid to be fed directly back into the reservoir.

The fluidic valve can be embodied separately from the pump housing and, when the pump is arranged in a fluid delivery cycle, arranged away from or on the pump housing. Preferably, however, the fluidic valve is an integral constituent part of the pump, as already mentioned, in that the pump housing also forms the housing for the fluidic valve. The pump housing can in particular form the valve space for the control piston. If the fluidic valve is integrated or arranged on the pump housing, the pump housing can form the pressure port, the working port and the relief port of the fluidic valve. The preferred relief channel can extend on and/or in the pump housing, such that if the fluidic valve is integrated or attached to the pump housing, it is not necessary to establish an additional connection for relieving pressure. The pump, including the fluidic valve, can form a fitted unit, such that when the pump housing is fitted in the fluid delivery cycle, the fluidic valve is automatically also at least mechanically fitted. In relation to fitting the pump housing and fluidic valve in the delivery cycle, it is also advantageous if the connections for the three ports of the fluidic valve mentioned are formed in and/or on the pump housing and there is no need for a connecting conduit or a port, separate from the pump housing, for the setting fluid. The setting fluid for the pressure port can then for example be diverted from the main flow in the pump housing on the latter's high-pressure side. If, however, the setting fluid is diverted at a point downstream of the pump housing on the high-pressure side, the diversion is preferably arranged downstream of a filter for cleaning the fluid, in order to feed cleaned setting fluid to the fluidic valve.

The control fluid for the fluidic valve can also be diverted from the high-pressure side of the pump. The control fluid can in particular be diverted at a point downstream of a filter for cleaning the fluid delivered by the pump, in order to feed cleaned fluid to a control chamber formed on the control piston. By diverting the control fluid at a point downstream of the filter, it is advantageously possible to regulate precisely to a pressure which is used in an internal combustion engine for supplying fluid. Varying losses of pressure, for example via a cooler and/or filter, are irrelevant. The control fluid can however in principle be diverted on the high-pressure side while still within the pump housing.

The setting fluid controlled by the fluidic valve can in particular also form the control fluid for operating the fluidic valve, in that the setting fluid which is guided into the valve space of the fluidic valve via the pressure port simultaneously also generates a control pressure which acts on the control piston. The pressure port can correspondingly also form a control port of the fluidic valve.

The electromagnetic valve comprises a signal port for connecting to an external controller, for example an engine controller. The signal port of the electromagnetic valve, or a magnetic force which acts counter to the tensing device of the electromagnetic valve, is preferably provided for setting a piston position in which the working port of the electromagnetic valve and therefore the second setting chamber is connected to the pressure port of the electromagnetic valve. The tensing force of the tensing device of the electromagnetic valve is preferably provided for setting a piston position in which the working port of the electromagnetic valve and therefore the second setting chamber is connected to the relief port of the electromagnetic valve. The electromagnetic valve can also be arranged in or on the pump housing, i.e. integrated. Alternatively, however, the electromagnetic valve can readily be arranged slightly away from the pump housing, which can be advantageous in particular when an electrical connecting conduit would have to be guided through oil when arranged in or on the pump housing. The term "provided" is in particular intended to be understood to specifically mean "programmed", "formed", "configured", "embodied", "equipped" and/or "arranged".

In preferred embodiments, the pump is a displacement pump. In displacement pumps, the delivery volume increases in proportion to the delivery speed of the delivery rotor if no steps are taken to adjust the delivery volume. If, as is preferred, the pump is a rotary pump, the delivery volume increases with the rotational speed of the delivery rotor which, in a rotary pump, can be rotated about a rotary axis within the delivery chamber. In principle, however, the invention also relates to linear stroke pumps. In generalised terms, the delivery volume is therefore proportional to the stroke frequency—the rotational stroke frequency or linear stroke frequency—of the pump. In the case of displacement pumps, reference is therefore also made to the specific delivery volume, i.e. the delivery volume per rotational or linear stroke. Proportionality is faulty in many applications, in particular when the speed at which the pump is driven cannot be adapted to the requirements of the assembly to be supplied. Pumps which are used in vehicles for example, such as lubricating oil pumps, servo pumps, such as for example gear pumps and coolant pumps, are in many cases mechanically driven by the drive motor of the vehicle. In these applications, the drive speed of the pump is dependent on the rotational speed of the drive motor and is in most cases in a fixed rotational speed relationship with the rotational speed of the drive motor. The invention is in particular directed to such applications.

In preferred embodiments, the adjusting device is configured to adjust the specific delivery volume of a displacement pump. Displacement pumps and adjusting devices such as the invention also in particular relates to are disclosed in the prior art discussed at the beginning. In addition to the vane cell pumps and externally toothed wheel pumps described therein, the invention also however relates to internally toothed wheel pumps and reciprocating piston valve pumps which can be adjusted in terms of their delivery volume, and in principle also to other pump designs which can be adjusted in terms of their delivery volume.

The adjusting device can in particular comprise an adjusting member which co-operates with the delivery rotor or, in pumps comprising multiple delivery rotors, at least one of the multiple delivery rotors, in order to adjust the delivery volume. If the pump is embodied as a vane cell pump comprising a delivery rotor which can be rotated within the delivery chamber, the adjusting member can in particular be an adjusting ring which surrounds the delivery rotor and which is arranged such that it can be moved linearly or pivoted within the pump housing, such that an adjusting movement of the adjusting member adjusts the eccentricity between the rotary axis of the delivery rotor and a central longitudinal axis of the adjusting ring and thus adjusts the delivery volume. The delivery volume of internally toothed ring pumps and reciprocating piston valve pumps can also be adjusted in a similar way. In an internally toothed ring pump, the internally toothed hollow wheel can in particular form the adjusting member and be arranged such that it can be moved linearly or pivoted for the purpose of adjusting. If the pump is embodied as an externally toothed wheel pump, it comprises at least two delivery rotors which are toothed on the outer circumference—so-called externally toothed wheels. The externally toothed wheels are in toothed engagement with each other. For adjusting the specific delivery volume, one of the externally toothed wheels can be axially adjusted relative to the other, such that the engagement length of the externally toothed wheels and thus the delivery volume of the pump can be adjusted. The adjustable externally toothed wheel is a constituent part of an adjusting unit which can be axially shifted and which comprises pistons which can be axially shifted and between which the adjustable externally toothed wheel is mounted such that it can be rotated. In such pump embodiments, the pistons which are connected to each other form the adjusting member of the adjusting device.

Advantageous features of the invention are also described in the sub-claims and combinations of the sub-claims.

Features of the invention are also described in the aspects formulated below. The aspects are worded in the manner of claims and can be substituted for them. Features disclosed in the aspects can also supplement and/or qualify the claims, indicate alternatives to individual features and/or broaden claim features. Bracketed reference signs refer to example embodiments of the invention which are illustrated below in figures. They do not restrict the features described in the aspects to their literal sense as such, but do on the other hand indicate preferred ways of realising the respective feature.

Aspect 1. A pump which exhibits an adjustable delivery volume, the pump comprising:

(a) a pump housing (2) comprising a delivery chamber (5) which comprises a delivery chamber inlet (4) on a low-pressure side of the pump (1), and a delivery chamber outlet (6) on a high-pressure side of the pump, for a fluid;

(b) a delivery rotor (10) which can be rotated about a rotary axis ($R_{10}$) within the delivery chamber (5), for delivering the fluid;

(c) an adjusting device, comprising:

(c1) an adjusting member (20) which can be adjusted back and forth in the pump housing (2) in a setting direction (V) and a restoring direction in order to adjust the delivery volume of the pump (1);

(c2) a first setting chamber ($K_1$) for generating a first setting pressure for adjusting the adjusting member (20);

(c3) and a second setting chamber ($K_2$) for generating a second setting pressure for adjusting the adjusting member (20);

(d) a fluidically operable valve (30) for adjusting the setting pressure of the first setting chamber ($K_1$);

(e) and an electromagnetic valve (40), comprising: a pressure port (P) for a setting fluid which is diverted from the high-pressure side; and a relief port (S) for the setting fluid, (f) wherein the electromagnetic valve (40) comprises a working port (A) for the setting fluid, which is connected to the second setting chamber ($K_2$), in order to adjust the setting pressure of the second setting chamber ($K_2$).

Aspect 2. The pump according to the preceding aspect, wherein the fluidically operable valve (30) comprises: a pressure port (P) for a setting fluid which is diverted from the fluid of the high-pressure side; a working port (A), connected to the first setting chamber ($K_1$), for the setting fluid; and a relief port (S) for the setting fluid.

Aspect 3. The pump according to any one of the preceding aspects, wherein the relief port (S) of the fluidically operable valve (30) of Aspect 2 and/or the relief port (S) of the electromagnetic valve (40) is/are connected to the low-pressure side of the pump (1), preferably directly connected to a suction region of the pump housing (2), at a point downstream of a reservoir (R) for the fluid.

Aspect 4. The pump according to any one of the preceding aspects, wherein the fluidically operable valve (30) comprises: a valve space (31); a control piston (32) which can be moved back and forth within the valve space (31) between a first piston position and a second piston position; a tensing device (33) for generating a tensing force which acts on the control piston (32) in the direction of one of the piston positions; and a control chamber (36) for generating a control force which acts on the control piston (32) counter to the tensing force of the tensing device (33); and the control chamber (36) comprises an inlet (C) for control fluid which is diverted on the high-pressure side of the pump (1).

Aspect 5. The pump according to the preceding aspect, wherein the pressure port (P) also forms the inlet (C) into the control chamber (36) of the fluidically operable valve (30).

Aspect 6. The pump according to any one of the preceding aspects, wherein the electromagnetic valve (40) comprises: a valve space; a control piston which can be moved back and forth within the valve space between a first piston position and a second piston position; a tensing device (43) for generating a tensing force which acts on the control piston in the direction of one of the piston positions; and an electromagnetic device (46) for generating an electromagnetic force which acts on the control piston counter to the tensing force of the tensing device (43); and the electromagnetic device (46) comprises a port (41) for connecting to an external controller, preferably an engine controller of a vehicle.

Aspect 7. The pump according to any one of the preceding aspects, wherein the fluidically operable valve (30) and the electromagnetic valve (40) are manifold valves comprising at least three ports (P, A, S), preferably precisely three ports, and at least two switching positions each.

Aspect 8. The pump according to any one of the preceding aspects, wherein the pump (1) is arranged in a fluid cycle, and a filter (48) for cleaning the fluid delivered by the pump (1) is arranged in the fluid cycle at a point downstream of the pump (1), and the setting fluid for the first setting chamber ($K_1$) and/or the control fluid for the fluidically operable valve (30) is/are diverted at a point downstream of the filter (48).

Aspect 9. The pump according to any one of the preceding aspects, wherein the pump (1) is arranged in a fluid cycle, and a filter (48) for cleaning the fluid delivered by the pump (1) is arranged in the fluid cycle at a point downstream of the pump (1), and the setting fluid for the second setting chamber ($K_2$) is diverted at a point downstream of the filter (48).

Aspect 10. The pump according to any one of the preceding aspects, comprising a restoring device (25), arranged in the pump housing (2), for generating a restoring force which acts on the adjusting member (20) in a restoring direction.

Aspect 11. The pump according to any one of the preceding aspects, wherein the first setting pressure acts on the adjusting member (20) in the setting direction (V).

Aspect 12. The pump according to any one of the preceding aspects, wherein the second setting pressure acts on the adjusting member (20) in the setting direction (V).

Aspect 13. The pump according to any one of the immediately preceding two aspects, wherein only one of the setting pressures acts on the adjusting member (20) in the setting direction (V), and the other of the setting pressures acts on the adjusting member (20) in the restoring direction.

Aspect 14. The pump according to any one of the preceding aspects, wherein the first setting pressure in the first setting chamber ($K_1$) and/or the second setting pressure in the second setting chamber ($K_2$) acts or each act directly on the adjusting member (20).

Aspect 15. The pump according to the preceding aspect, wherein the first setting chamber ($K_1$) and/or the second setting chamber ($K_2$) is/are (each) arranged such that the first setting pressure and/or the second setting pressure acts or each act on the adjusting member (20) in the setting direction (V).

Aspect 16. The pump according to any one of the preceding aspects, wherein the adjusting member (20) surrounds the delivery rotor (10) or is arranged on an end-facing side of the delivery rotor (10).

Aspect 17. The pump according to any one of the preceding aspects, wherein the adjusting member (20) surrounds the delivery rotor (10) and can be pivoted or translationally moved transverse or translationally parallel to the rotary axis ($R_{10}$) of the delivery rotor (10) relative to the delivery rotor (10) in order to perform the setting movement, wherein the adjusting member (20) together with the delivery rotor (10) preferably forms delivery cells in which the fluid can be delivered from the delivery chamber inlet (4) to the delivery chamber outlet (6) by rotating the delivery rotor (10).

Aspect 18. The pump according to any one of the preceding aspects, wherein the pump (1) is a displacement pump, preferably a vane pump, an internally toothed wheel pump, a reciprocating piston valve pump or an externally toothed wheel pump.

Aspect 19. The pump according to any one of the preceding aspects, wherein the pump is driven in accordance with the speed of an assembly (M) to be supplied with the fluid by the pump and is preferably driven by the assembly (M) in a fixed rotational speed relationship.

Aspect 20. The pump according to any one of the preceding aspects, wherein the fluid is a lubricating oil, and the pump is a lubricating oil pump in a lubricating oil delivery cycle of a combustion engine, preferably a drive motor of a motor vehicle, and is used to supply the combustion engine with the lubricating oil.

Aspect 21. The pump according to any one of the preceding aspects, wherein the fluid is used as a working fluid, and the pump (1) supplies a transmission, such as for example an automatic transmission, preferably a transmission of a vehicle, with the working fluid.

BRIEF DESCRIPTION OF THE DRAWINGS

An example embodiment of the invention is described below on the basis of figures. Features disclosed by the example embodiment, each individually and in any combination of features, advantageously develop the subject-matter of the claims and the embodiments described above and also the subject-matter of the aspects. There is shown:

DETAILED DESCRIPTION OF THE INVENTION

Figure 1:
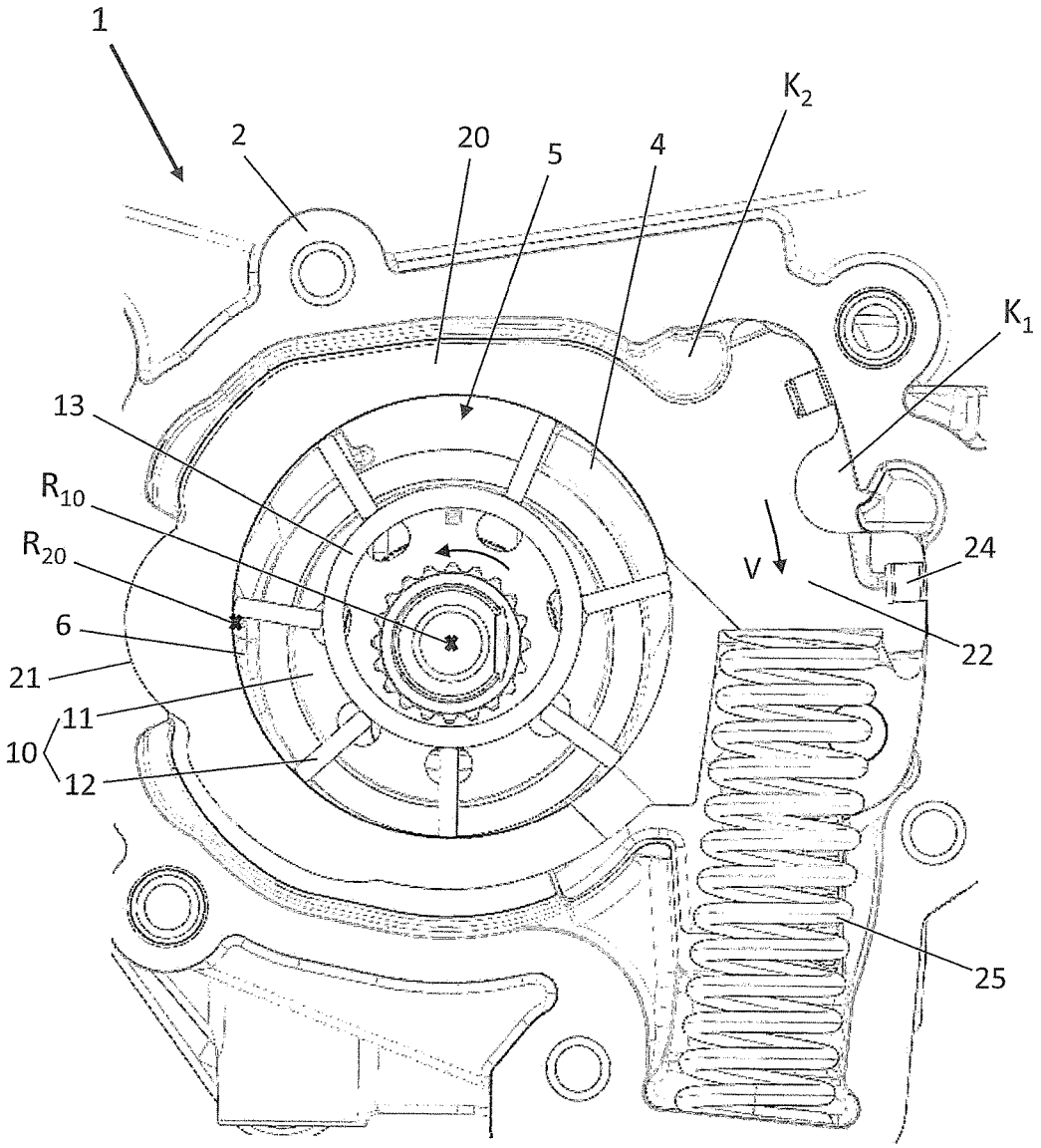
FIG. 1 a pump which can be adjusted in terms of its delivery volume and which comprises an adjusting member and multiple setting chambers for applying pressurised setting fluid to the adjusting member.

FIG. 1 shows a pump 1 in a vane cell design by way of example. The pump 1 comprises a pump housing comprising a housing structure 2 and a cover. The housing structure 2 accommodates and/or mounts components of the pump 1 such that they can be moved. The housing structure 2 is open on an axial end-facing side, thus facilitating the arrangement of components of the pump in or on the housing structure 2. The cover can be fitted to the housing structure 2 and, when fitted, seals the housing structure 2 on the end-facing side in question. The cover has been removed in FIG. 1, such that functional components of the pump can be seen in the plan view onto the open housing structure 2 shown.

The housing structure 2 surrounds a delivery chamber 5 in which a delivery rotor 10 is arranged such that it can be rotated about a rotary axis $R_{10}$. The pump housing comprises a housing inlet on a low-pressure side for connecting the pump 1 to a reservoir R, and a housing outlet on a high-pressure side for discharging a fluid to be delivered, for example engine lubricating oil, to an assembly to be supplied with the fluid. The delivery chamber 5 comprises a low-pressure side and a high-pressure side. When the delivery rotor 10 is rotary-driven in the rotational direction indicated, i.e. anticlockwise, fluid flows through the housing inlet into the pump housing and through a delivery chamber inlet 4 on the low-pressure side in the pump housing, into the delivery chamber 5, and is expelled at an increased pressure through a delivery chamber outlet 6 on the high-pressure side of the pump and discharged via the housing outlet. A suction region is formed on the low-pressure side of the pump housing, wherein the fluid delivered by the pump flows through the suction region on its flow path from the housing inlet to the delivery chamber inlet 4. The suction region extends up to and into the delivery chamber 5 and also comprises the region of the delivery chamber 5 in which the delivery cells increase in size when the delivery rotor 10 is rotated. A high-pressure region of the pump housing which adjoins the suction region on the flow path comprises the region of the delivery chamber 5 in which the delivery cells decrease in size and extends from this partial region of the delivery chamber 5 up to and including the housing outlet via the delivery chamber outlet 6.

The delivery rotor 10 is an impeller comprising a rotor structure 11, which is central with respect to the rotary axis $R_{10}$, and vanes 12 which are arranged in a distribution over the circumference of the rotor structure 11. The vanes 12 are guided, such that they can be shifted in a sliding manner in the radial direction or at least substantially in the radial direction, in slots in the rotor structure 11 which are open towards the outer circumference of the rotor structure 11. The vanes 12 are supported on the radially inner side on a supporting structure 13 which can be moved transverse to the rotary axis $R_{10}$.

The outer circumference of the delivery rotor 10 is surrounded by an adjusting member 20 which is, by way of example, shaped as an adjusting ring. When the delivery rotor 10 is rotary-driven, its vanes 12 slide over an inner circumferential surface of the adjusting member 20. The rotary axis $R_{10}$ of the delivery rotor 10 is arranged eccentrically with respect to a parallel axis of the adjusting member 20 which is central in relation to the inner circumferential surface, such that delivery cells formed by the delivery rotor 10 and the adjusting member 20 increase in size on the low-pressure side of the delivery chamber 5 and decrease in size again on the high-pressure side in the rotational direction when the delivery rotor 10 is rotated. Because the delivery cells increase and decrease in size periodically with the rotational speed of the delivery rotor 10 in this way, the fluid is delivered from the low-pressure side to the high-pressure side, where it is delivered at an increased pressure through the delivery chamber outlet 6 and then through the housing outlet.

The volume of fluid delivered by each revolution of the delivery rotor 10, the so-called specific delivery volume, can be adjusted. If the fluid is a liquid and thus a good approximation of an incompressible fluid, the absolute delivery volume is directly proportional to the rotational speed of the delivery rotor 10. In the case of compressible fluids, for example air, the relationship between the delivered amount and the rotational speed may not be linear, but the absolute delivered amount and/or mass likewise increases with the rotational speed.

The specific delivery volume depends on the eccentricity, i.e. the distance between the central axis of the adjusting member 20 and the rotary axis $R_{10}$ of the delivery rotor 10. In order to be able to change this axial distance, the adjusting member 20 is arranged such that it can be moved within the pump housing—by way of example, pivoted about a pivot axis $R_{20}$. In variations, a modified adjusting member can also be arranged such that it can be linearly moved within the pump housing. For adjusting the specific delivery volume and/or eccentricity, it is preferably able to move transverse to the rotary axis $R_{10}$ of the delivery rotor 10. It would in principle also be conceivable for it to be axially adjustable, thus enabling an axial width of the delivery cells to be adjusted.

A pivot bearing region of the adjusting member 20 is denoted by 21. The pivot bearing is embodied as a slide bearing, in that the pivot bearing region 21 of the adjusting member 20 is in direct sliding contact with a co-operating surface of the housing structure 2.

For the purpose of adjusting in a setting direction V—in the example embodiment, the pivoting direction—a setting pressure of a setting fluid is applied to the adjusting member 20. A restoring force acts in the opposite direction—the restoring direction—counter to the fluidic setting pressure. The restoring force is generated by a spring device 25 comprising one or more mechanical spring members—in the example embodiment, a single spring member. The spring member is embodied and arranged as a helical pressure spring. For the purpose of applying pressure using the setting fluid, the side of the adjusting member 20 which lies opposite as viewed from the pivot axis $R_{20}$ across the rotary axis $R_{10}$ of the delivery rotor 10 comprises an acting region 22 of the adjusting member 20 which functionally acts as an adjusting piston. On one side of the acting region 22 of the adjusting member 20, a first setting chamber $K_1$ is formed in the pump housing, into which the setting fluid can be introduced in order to exert a first setting force, which acts in the setting direction V, on the acting region 22 of the adjusting member 20 and thus on the adjusting member 20. The restoring force of the spring device 25 likewise, by way of example, acts directly on the acting region 22 of the adjusting member 20.

The first setting chamber $K_1$ is fed with the setting fluid delivered by the pump 1, in order to apply the first setting pressure to the adjusting member 20 in the setting direction V, against the force of the spring device 25. The setting direction V is selected such that the eccentricity between the delivery rotor 10 and the adjusting member 20 and thus the specific delivery volume of the pump 1 decreases in size when the adjusting member 20 is moved in the setting direction V.

The adjusting member 20 together with the housing structure 2 forms a sealing gap which separates the first setting chamber $K_1$ from the low-pressure region in the setting direction V. A sealing element 24 is arranged in the sealing gap in order to better seal off the sealing gap. The sealing element 24 is arranged in a receptacle of the adjusting member 20.

A second setting chamber $K_2$ is formed in the pump housing, into which a pressurised setting fluid can likewise be introduced in order to be able to exert another, second setting pressure on the adjusting member 20 in the second setting chamber $K_2$. The setting chambers $K_1$ and $K_2$ are formed adjacently in the circumferential direction on an outer circumference of the adjusting member 20 and are sealed off from each other by means of another sealing element. In the two setting chambers $K_1$ and $K_2$, the respective setting fluid acts directly on the adjusting member 20. Instead of applying pressure directly, it would be possible in modified embodiments to arrange for the pressure to be applied to the adjusting member 20 indirectly using two or more setting pistons, wherein the first setting pressure would act on at least one such setting piston and the second setting pressure would act on at least one other setting piston. The adjusting device can comprise another setting chamber, or as applicable multiple other setting chambers, in which a setting fluid acts on the adjusting member 20 directly or instead indirectly via a setting piston in each case.

The first setting pressure which prevails in the first setting chamber $K_1$ and the second setting pressure which prevails in the second setting chamber $K_2$ can be altered by applying the respective setting fluid to the setting chambers $K_1$ and $K_2$, respectively, via an assigned valve. Setting fluid is applied to one of the setting chambers $K_1$ and $K_2$ via a fluidic valve, while setting fluid is applied to the other of the setting chambers $K_1$ and $K_2$ via an electromagnetic valve. In the example embodiment, the fluidic valve is assigned to the first setting chamber $K_1$, and the electromagnetic valve is assigned to the second setting chamber $K_2$.

Figure 2:
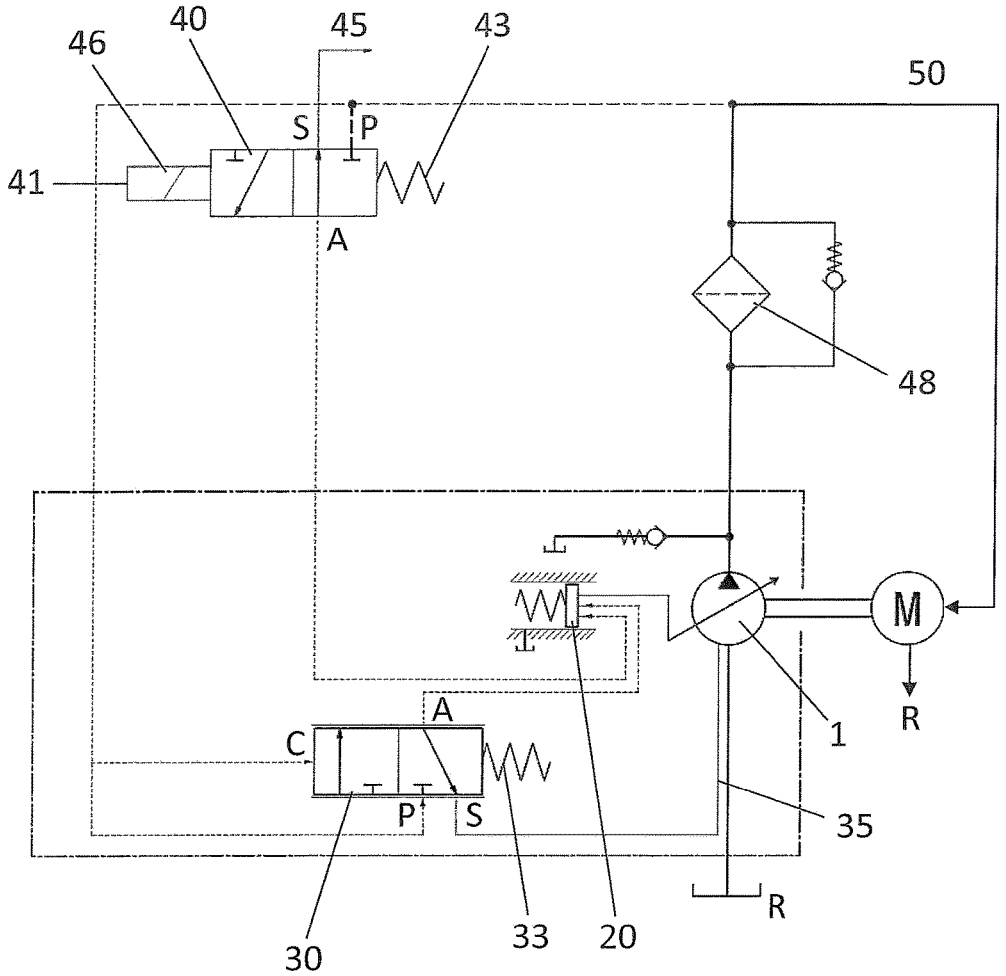
FIG. 2 the pump together with assigned valves for adjusting the delivery volume and delivery characteristics of the pump.

FIG. 2 shows a fluid delivery cycle containing the pump 1. The pump 1 is shown schematically, as are the other components of the fluid cycle. As can be seen from FIG. 1, the pump 1 thus includes the adjusting device comprising the adjusting member 20, the spring device 25 and the setting chambers $K_1$ and $K_2$. In preferred embodiments, the fluidic valve 30 is also an integral constituent part of the pump housing, in that the fluidic valve 30 is arranged in or on the pump housing. The electromagnetic valve 40 is also regarded as forming part of the pump 1, although the electromagnetic valve 40 can be arranged slightly away from the pump housing. Arranging it externally in relation to the pump housing can in particular be advantageous when the electrical insulation of a feed conduit for electrical energy and/or control signals causes problems in the immediate environment of the pump housing.

The pump 1 delivers fluid, for example lubricating oil, from a reservoir R to an assembly M to be supplied with the fluid, for example an internal combustion engine for driving a motor vehicle, which forms the assembly M. An assembly M which is formed by an internal combustion engine and is to be supplied with the fluid can drive the pump 1, as illustrated in FIG. 2, such that the delivery rotor 10 is rotary-driven in a fixed rotational speed relationship with an output shaft of the assembly M. On the low-pressure side, the pump 1 delivers the fluid from the reservoir R through a feed conduit, the housing inlet and the suction region of the pump housing, into the delivery chamber 5 (FIG. 1), from which it is expelled at an increased pressure. On the high-pressure side, a main flow 50 which is delivered by the pump 1 is delivered to the assembly M via a filter 48. Once it has flowed through the assembly M, the fluid—relieved of pressure—flows back into the reservoir R.

A smaller portion is diverted from the main flow 50 and guided, as a setting fluid, to a pressure port P of the fluidic valve 30. The pressure port P is correspondingly connected to the main flow 50 via a secondary flow conduit. The fluidic valve 30 is connected to the first setting chamber $K_1$ (FIG. 1) via a working port A. In FIG. 2, the adjusting member 20 also stands for the other components of the adjusting device, such as for example the spring member 25 and the setting chambers $K_1$, $K_2$ and optionally one or more other setting chambers.

The fluidic valve 30 also comprises a relief port S for the setting fluid. The relief port S is directly connected to the suction region of the pump housing via a relief channel 35. The reservoir R is bypassed. The relief channel 35 preferably extends in or on the pump housing directly from the fluidic valve 30 all the way to the suction region of the pump housing. No fluid flows directly to the reservoir R through the relief port S, and no fluid flows from the reservoir R to the fluidic valve 30 through the relief port S. There is therefore no direct fluid communication between the relief port S and the reservoir R. The pressurised setting fluid is fed back into the suction region of the pump housing energy-efficiently via the relief port S. Setting fluid which is fed back for relieving pressure on the adjusting member 20 does not first have to be suctioned again from the reservoir R by the pump 1. The setting fluid, which is fed back via a short path, exhibits a higher pressure than the fluid situated in the reservoir R and contains less air. Both these factors help to improve the effectiveness of the pump 1.

Although relieving pressure into the suction region of the pump housing provides a whole series of advantages over relieving pressure into the reservoir R, the fluidic valve 30 can be relieved of pressure towards the reservoir R via its relief port S in modified embodiments.

The fluidic valve 30 is operated using a control fluid which is also diverted from the high-pressure side of the pump 1 and which is guided to a control port C of the fluidic valve 30.

The electromagnetic valve 40 can be a proportional valve using which the setting pressure in the second setting chamber $K_2$ (FIG. 1) can be continuously adjusted. It can in particular however also be a manifold switching valve which can be switched between two, three or as applicable even more switched states and therefore piston positions. In the example embodiment, the electromagnetic valve 40 is such a switching valve and connects the second setting chamber $K_2$ to the high-pressure side of the pump 1 in a first switched state and separates it from the high-pressure side of the pump 1 and instead connects it to the low-pressure side of the pump 1 via a feedback conduit 45, by bypassing the reservoir R, in a second switched state. The second setting chamber $K_2$ is therefore connected to the high-pressure side of the pump 1 when the electromagnetic valve 40 is in the first switched state, and to the low-pressure side of the pump 1 when the electromagnetic valve 40 is in the second switched state. If the electromagnetic valve 40 assumes the first switched state, the setting pressures in the setting chambers $K_1$ and $K_2$ jointly act on the adjusting member 20. If the electromagnetic valve 40 assumes the second switched state, the setting pressure only then acts on the adjusting member 20 in the first setting chamber $K_1$, while the comparatively low pressure of the suction region of the pump housing prevails in the second setting chamber $K_2$. This first setting pressure has to be corresponding higher in order to move the adjusting member 20 in the setting direction V, against the restoring tensing force of the spring device 25.

It also holds for the electromagnetic valve 40 that while the relief port S of the electromagnetic valve 40 is preferably connected directly to the suction region of the pump housing, alternatively relieving the pressure on the electromagnetic valve 40 into the reservoir R is not however to be excluded.

The electromagnetic valve 40 comprises a signal port 41 at which it is connected to an external controller. If the assembly M is a drive motor of a vehicle, an engine controller can in particular form the external controller. Such engine controllers are typically formed as characteristic-curve controllers or characteristic-map controllers. In an engine characteristic-map controller, the requirements of the drive motor can be stored in an electronic memory of the controller in a characteristic map of different engine variables, for example a temperature and/or rotational speed of the engine and/or a lubricating oil pressure at a critical point in the engine and/or the load state of the engine and so forth. On the basis of corresponding measured variables and the stored characteristic map, the external controller forms the output signal using which it actuates the electromagnetic valve 40 in order to modulate the delivery pressure of the pump 1. The modulation resides in the fact that by means of the electromagnetic valve 40, it is possible to alter the size of the delivery pressure at which the specific delivery volume of the pump 1 is reduced by adjusting the adjusting member 20.

The electromagnetic valve 40 comprises a valve piston, a solenoid 46 coupled to the valve piston and operable in response to signals received via signal port 41, and a spring means 43 exerting a spring force onto the valve piston counter to a force the solenoid 46 does exert onto the valve piston in response to the signals received via signal port 41.

Figure 3:
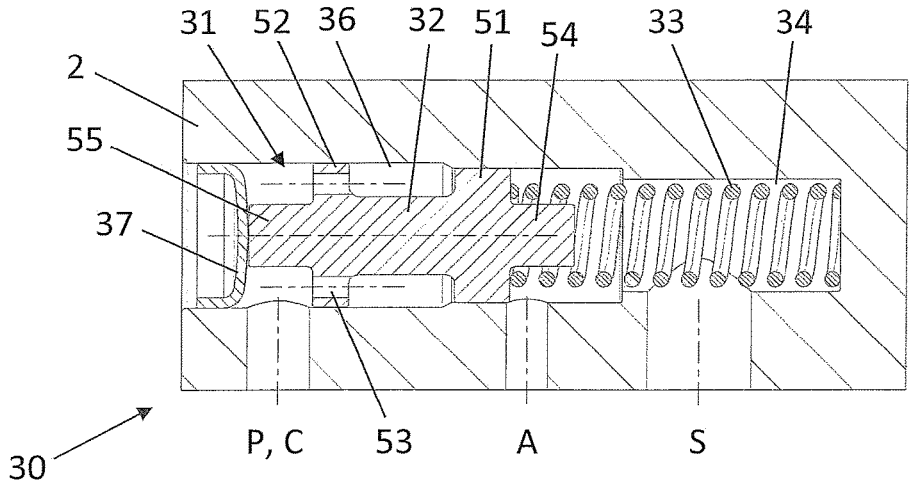
FIG. 3 one of the assigned valves, in a longitudinal section.

FIG. 3 shows the fluidic valve 30 in a longitudinal section. The ports A, P and S for the setting fluid and the port C for the control fluid can be seen. The fluidic valve 30 is an integral constituent part of the pump 1, in that the pump housing also forms the housing of the fluidic valve 30. The pump 1, including the fluidic valve 30, can be fitted as a unit. The delivery and adjusting components, such as in particular the delivery rotor 10 and the adjusting member 20, and the fluidic valve 30 are combined by means of the common pump housing to form a fitted unit.

The valve space 31 is formed in the housing structure 2, as an axial blind bore by way of example. It is open at one of the two end faces of the control piston 32. A sealing part 37 seals the valve space 31 at the open end. A tensing chamber 34, in which the tensing device 33 acts on the control piston 32, is formed in an axial end region of the valve space 31.

The relief channel 35 (FIG. 2) feeds into the tensing chamber 34, such that the tensing chamber 34 is connected to the suction region of the pump housing in any state of the fluidic valve 30, i.e. irrespective of the position of the control piston 32. In FIG. 3, the relief channel extends perpendicular to a shifting axis of the control piston 32, out of the tensing chamber 34. Alternatively or additionally, the relief channel can extend obliquely, in parallel or in an extension of the shifting axis of the control piston 32, out of the tensing chamber 34.

The control piston 32 can be moved back and forth within the valve space 31 between a first piston position and a second piston position. In FIG. 3, the control piston 32 has assumed the second piston position. In the second piston position, the working port A is connected to the relief port S. The setting fluid can flow into the valve space 31 via the working port A and flow off from the valve space 31 into the suction region of the pump housing via the relief port S. When the fluidic valve 30 is in this state and the control piston 32 is in the second piston position, the first setting chamber $K_1$ is pressurised to the comparatively low pressure of the suction region, thus effectively relieving pressure on the adjusting member 20.

If the control piston 32 is moved from the second piston position into the first piston position, i.e. to the right in FIG. 3, the pressure port P is connected to the working port A, and via the working port A to the first setting chamber $K_1$, such that the setting pressure—a pressure of the high-pressure side of the pump 1—is applied to the adjusting member 20, wherein the adjusting device is configured such that an increase in the setting pressure causes a reduction in the specific delivery volume of the pump 1.

The control port C, indicated at the fluidic valve 30 in the schematic in FIG. 2, can be combined with the pressure port P, as can be seen in FIG. 3. Correspondingly, the pressure port P can also simultaneously form the control port C. A control chamber 36 which is formed in the valve space 31 and in which the fluidic control force is applied to the control piston 32, counter to the tensing force of the tensing device 33, also forms a connecting chamber for the ports P and A when the control piston 32 is in the first piston position.

The inlet C of the fluidic valve 30 is permanently attached to the high-pressure side of the pump 1. A control pressure and therefore a control force against the tensing device 33 permanently acts on the control piston 32 while the pump 1 is in operation. The tensing device 33 of the fluidic valve 30 is biased. It permanently exerts, on the control piston 32, a tensing force which acts against the control force and is greater than a maximum control force, acting on the control piston 32, which occurs when the electromagnetic valve 40 is properly functioning and actively actuated. A properly functioning and active electromagnetic valve 40 regulates the pump 1 during operations, via the second setting chamber $K_2$, in such a way as to result in a maximum control force acting on the control piston 32 which is smaller than the tensing force of the tensing device 33 of the fluidic valve 30 and therefore smaller than the control force necessary for switching the first switching position and therefore the first piston position. In operational states in which the electromagnetic valve 40 is active and functioning properly, the fluidic valve 30 is always switched to its second switching position and therefore the second piston position, since the electromagnetic valve 40 regulates the pump 1 to a maximum delivery output which results in a control force acting on the control piston 32 of the fluidic valve 30 which is smaller than the counteractive tensing force of the tensing device 33. The control force acting on the control piston 32 of the fluidic valve 30 which results from the maximum delivery output is not sufficient to switch the fluidic valve 30 from the second switched state to the first switched state or to shift the control piston 32 from the second piston position to the first piston position.

The control force acting on the control piston 32, and the tensing force of the tensing device 33 of the fluidic valve 30, do not solely determine the switching position of the fluidic valve 30 when the electromagnetic valve 40 is properly and actively functioning. The control force acting on the control piston 32, and the tensing device 33, imbue the fluidic valve 30 with a fail-safe feature if the electromagnetic valve 40 fails. The control force acting on the control piston 32, and the tensing device 33, are used as a back-up for applying pressure to the adjusting member 20 in case the electromagnetic valve 40 or the assigned control device fails due to a defect, for example because a cable breaks or an electrical plug connection becomes detached, or when the electromagnetic valve 40 is deactivated in particular operational states. The fluidic valve 30, in particular the tensing device 33, is configured such that if the electromagnetic valve 40 fails or is deactivated, the delivery volume of the pump 1 is adjusted from a maximum towards a minimum only once a pump output pressure has been reached which is greater than a maximum pump output pressure which is set when the electromagnetic valve 40 is properly and actively functioning, and smaller than a pump output pressure which would result in damage to at least one component. The fluidic valve 30 and the first setting chamber $K_1$ are used to protectively regulate the pump 1 down, when the electromagnetic valve 40 fails because it is defect or deactivated.

The control piston 32 comprises a first annular portion 51 and a second annular portion 52 which are axially spaced from each other. The first annular portion 51 fluidically separates the control chamber 36 and the tensing chamber 34 from each other. In the second piston position, the first annular portion 51 separates the pressure port P and the working port A from each other and connects the relief port S to the working port A. In the first piston position, the first annular portion 51 separates the working port A and the relief port S from each other and connects the pressure port P to the working port A. The first annular portion 51 comprises a single sealing surface which is embodied to be continuous and therefore uninterrupted in the circumferential direction and axially. The sealing surface of the first annular portion 51 abuts the housing structure 2, forming a seal. It exhibits a constant diameter. The first annular portion 51 is formed as a solid body and is therefore not embodied to be hollow.

The second annular portion 52 is arranged in the control chamber 36. The second annular portion 52 is arranged axially between the pressure port P and/or inlet C and the first annular portion 51. The second annular portion 52 comprises axial passage openings 53 which fluidically connect the pressure port P and the inlet C to the first annular portion 51. The passage holes 53 therefore connect a control surface of the first annular portion 51 to the pressure port P and the inlet C. The passage holes 53 are embodied as bores. The first annular portion 51 exhibits a diameter which is smaller than the diameter of the second annular portion 52, thus making it possible to ensure that the control piston 32 is correctly fitted. It is in principle conceivable for the first annular portion 51 to exhibit a diameter which is greater than the diameter of the second annular portion 52. The inner diameter of the housing of the fluidic valve 30 is correspondingly embodied to be stepped. The housing of the fluidic valve 30 comprises two regions which differ from each other in their inner diameter. The diameter of the annular portions 51, 52 respectively abuts the inner diameter of the housing. In order to form the housing of the fluidic valve 30, the housing structure 2 comprises a stepped bore. The housing structure 2 forms the housing of the fluidic valve 30.

For arranging the tensing device 33, the control piston 32 comprises a first axial protrusion 54 on which the tensing device 33, in particular the helical spring, is arranged or fitted. The first axial protrusion 54 forms a spring seating. The tensing device 33, in particular the helical spring, surrounds the first axial protrusion 54. The first axial protrusion 54 extends from the first annular portion 51 axially into the tensing chamber 34. The tensing device 33, in particular the helical spring, is supported at one end on the first annular portion 51.

In order to form an abutment for the second piston position, a second axial end of the control piston 32 comprises a second axial protrusion 55. The second axial protrusion 55 forms an abutment in the second piston position in which the pressure port P and the working port A are separated from each other. In the second piston position, the second axial protrusion 55 abuts a counter abutment. The counter abutment is formed by the sealing part 37. The second axial protrusion 55 extends from the second annular portion 52 axially towards the sealing part 37. The axial protrusions 54, 55 exhibit a diameter which is respectively smaller than the diameters of the annular portions 51, 52.

The invention claimed is:

1. A pump which exhibits an adjustable delivery volume, the pump comprising:

(a) a pump housing comprising a delivery chamber which comprises a delivery chamber inlet on a low-pressure side of the pump, and a delivery chamber outlet on a high-pressure side of the pump, for a fluid;

(b) a delivery rotor which can be rotated about a rotary axis within the delivery chamber, for delivering the fluid;

(c) an adjusting device, comprising:

(c1) an adjusting member which can be adjusted back and forth in the pump housing in a setting direction and a restoring direction in order to adjust the delivery volume of the pump;

(c2) a first setting chamber for generating a first setting pressure for adjusting the adjusting member in the setting direction;

(c3) and a second setting chamber for generating a second setting pressure for adjusting the adjusting member in the setting direction;

(d) a restoring device, arranged in the pump housing, for generating a restoring force which acts on the adjusting member in the restoring direction;

(e) a fluidically operable valve for adjusting the setting pressure of the first setting chamber, the fluidically operable valve comprising: a pressure port for a setting fluid which is diverted from the fluid of the high-pressure side; a working port, connected to the first setting chamber, for the setting fluid; and a relief port for the setting fluid;

(f) and an electromagnetic valve, comprising: a pressure port for a setting fluid which is diverted from the high-pressure side; and a relief port for the setting fluid, (g) wherein the electromagnetic valve comprises a working port for the setting fluid, which is connected to the second setting chamber, in order to adjust the setting pressure of the second setting chamber.

2. The pump according to claim 1, wherein the relief port of the fluidically operable valve and/or the relief port of the electromagnetic valve is/are connected to the low-pressure side of the pump, at a point downstream of a reservoir for the fluid.

3. The pump according to claim 1, wherein the fluidically operable valve comprises: a valve space; a control piston which can be moved back and forth within the valve space between a first piston position and a second piston position; a tensing device for generating a tensing force which acts on the control piston in the direction of one of the piston positions; and a control chamber for generating a control force which acts on the control piston counter to the tensing force of the tensing device; and the control chamber comprises an inlet, which is permanently attached to the high-pressure side of the pump, for a control fluid.

4. The pump according to claim 3, wherein the tensing device of the fluidically operable valve exerts a tensing force which is greater than a control force which occurs when the electromagnetic valve is properly and/or actively functioning.

5. The pump according to claim 3, wherein the control piston comprises at least a first annular portion, which separates the pressure port and the working port from each other in one piston position and separates the working port and the relief port from each other in another piston position, and a second annular portion which comprises at least one passage opening and is arranged axially between the pressure port and the first annular portion.

6. The pump according to claim 5, wherein one axial end of the control piston comprises a first axial protrusion for arranging the tensing device, and another axial end of the control piston comprises a second axial protrusion for forming an abutment.

7. The pump according to claim 5, wherein at least the first annular portion is formed as a solid body.

8. The pump according to claim 5, wherein the annular portions differ from each other in their diameter.

9. The pump according to claim 3, wherein the pressure port of the fluidically operable valve also forms the inlet into the control chamber of the fluidically operable valve.

10. The pump according to claim 1, wherein the fluidically operable valve comprises a housing which comprises at least two regions which differ from each other in their inner diameter.

11. The pump according to claim 1, wherein the electromagnetic valve comprises: a valve space; a control piston which can be moved back and forth within the valve space between a first piston position and a second piston position; a tensing device for generating a tensing force which acts on the control piston in the direction of one of the piston positions; and an electromagnetic device for generating an electromagnetic force which acts on the control piston counter to the tensing force of the tensing device; and the electromagnetic device comprises a port for connecting to an external controller.

12. The pump according to claim 11, wherein the tensing device of the electromagnetic valve is provided for setting a piston position in which the second setting chamber is connected to the relief port of the electromagnetic device.

13. The pump according to claim 1, wherein the pump is arranged in a fluid cycle, and a filter for cleaning the fluid delivered by the pump is arranged in the fluid cycle at a point downstream of the pump, and the setting fluid for at least one of the setting chambers and/or the control fluid for the fluidically operable valve is/are diverted at a point downstream of the filter.

14. The pump according to claim 1, wherein the relief port of the fluidically operable valve and/or the relief port of the electromagnetic valve is/are connected to a suction region of the pump housing at a point downstream of a reservoir for the fluid.

15. The pump according to claim 4, wherein the control piston comprises at least a first annular portion, which separates the pressure port and the working port from each other in one piston position and separates the working port and the relief port from each other in another piston position, and a second annular portion which comprises at least one passage opening and is arranged axially between the pressure port and the first annular portion.

16. The pump according to claim 6, wherein at least the first annular portion is formed as a solid body.

* * * * *